US007344815B2

(12) United States Patent
Hirose et al.

(10) Patent No.: US 7,344,815 B2
(45) Date of Patent: Mar. 18, 2008

(54) TONER FOR FORMING ELECTROSTATIC IMAGE

(75) Inventors: Naohiro Hirose, Hachioji (JP); Asao Matsushima, Hachioji (JP); Meizo Shirose, Hachioji (JP); Hiroshi Yamazaki, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/056,577

(22) Filed: Jan. 24, 2002

(65) Prior Publication Data

US 2002/0142243 A1 Oct. 3, 2002

(30) Foreign Application Priority Data

Jan. 29, 2001 (JP) ..... 2001/019638

(51) Int. Cl.
*G03G 9/087* (2006.01)

(52) U.S. Cl. ..... 430/109.3; 430/110.3; 430/110.4; 430/137.14; 430/119.88; 430/123.5

(58) Field of Classification Search ..... 430/110.3, 430/110.4, 137.15, 109.3, 137.14, 123.5, 430/119.88
See application file for complete search history.

(56) References Cited

U.S. PATENT DOCUMENTS

| | | | | |
|---|---|---|---|---|
| 4,737,433 | A * | 4/1988 | Rimai et al. | 430/110.4 |
| 5,698,354 | A * | 12/1997 | Ugai et al. | 430/45 |
| 5,773,185 | A * | 6/1998 | Yachi et al. | 430/137.17 |
| 5,948,584 | A * | 9/1999 | Hashimoto et al. | 430/109.3 |
| 6,177,223 | B1 * | 1/2001 | Hashimoto et al. | 430/126 |
| 6,214,509 | B1 * | 4/2001 | Kasuya et al. | 430/110.3 |
| 6,447,968 | B1 * | 9/2002 | Ohno | 430/106.2 |
| 6,555,281 | B1 * | 4/2003 | Nozawa et al. | 430/108.6 |
| 6,610,454 | B2 * | 8/2003 | Hashimoto et al. | 430/110.3 |
| 2001/0018158 | A1 * | 8/2001 | Yoshida et al. | 430/125 |

FOREIGN PATENT DOCUMENTS

| | | |
|---|---|---|
| JP | 61279864 | 12/1986 |
| JP | 1112253 | 4/1989 |
| JP | 2284158 | 11/1990 |
| JP | 08220794 | 8/1996 |
| JP | 2000-29311 | 1/2000 |
| JP | 2000-56502 | 2/2000 |
| JP | 2000-56503 | 2/2000 |
| JP | 2000-105488 | 4/2000 |
| JP | 2000105488 | 4/2000 |
| JP | 2000-267331 | 9/2000 |
| JP | 2000267331 | 9/2000 |
| JP | 2000267348 | 9/2000 |
| JP | 2000-321950 | 11/2000 |
| JP | 2000-338709 | 12/2000 |

OTHER PUBLICATIONS

Bromberg, J. Philip. Physical Chemistry. Boston: Allyn & Bacon, Inc. (1984) pp. 637-640.*

* cited by examiner

*Primary Examiner*—Christopher RoDee
(74) *Attorney, Agent, or Firm*—Lucas & Mercanti, LLP

(57) ABSTRACT

A toner for developing an electrostatic image is disclosed. The arithmetic average of shape coefficient SF-1 of the toner particles calculated by Equation 1 is from 125 to 170 and a ratio of that to an arithmetic average of the shape coefficient SF-2 of the toner particles calculated by Equation 2, SF-1/SF-2, is from 1.10 to 1.52 and the ratio of the toner particles having a circle corresponding diameter measured by a flow particle image analyzer of from not less than 0.60 to less than 1.00 μm is not more than 5.0% in number. The image forming methods employing the toner are also disclosed.

14 Claims, 1 Drawing Sheet

TONER FOR FORMING ELECTROSTATIC IMAGE

FIELD OF THE INVENTION

This invention relates to a toner for developing a static latent image, a production method of the toner and an image forming method to be utilized to a copying machine or a printer.

BACKGROUND OF THE INVENTION

Various electronic photographic methods have been known. The method is usually composed of the following procedures: An electrostatic image is formed on a photoreceptor by various methods, the electrostatic image is developed to a visible image by a toner or a developer each having a charge opposite to the polarity to the charge of the electrostatic latent image, the toner image is transferred onto a image receiving material such as a paper sheet according to necessity, and the toner image is fixed on the image receiving material by heating or pressing to obtain a copy.

The developing process of the electrophotographic method is principally classified into a single-component developing system and a double-component developing system. The developer to be used for the single-component developing system includes one comprised of a non-magnetic toner containing no magnetic material and a magnetic toner containing a magnetic material. Recently, the developing system using the non-magnetic single-component developer is mainly used.

In the developing system using the non-magnetic single-component developer, any carrier particle used in the double-component developer is not necessary and the developing member can be miniaturized and made light in the weight.

In the case of the double-component developing system, an apparatus for detecting the concentration of the toner in the developer and replenishing a necessary amount of the toner since it is necessary to hold the toner concentration in the developer which is a mixture of the toner and the carrier. Therefore, the developing apparatus is made large and heavy. The single-component developing system is preferred as a simple method since such the toner concentration controlling mechanism is not necessary in such the developing system. Recently, therefore, the developing apparatus using the single-component developer is widely used.

However, the double-component developing system is advantageous from the viewpoint of the design since the allowable range of the design of the materials and the using conditions is wide because the charge providing function is separated in such the developer. Consequently, the double-component developing system is widely used yet.

Recently, in the field of printer, ones using a LED or a LB as the light source are mainly used and the development of technology is directed to make higher the image resolution. The image resolution is recently improved to 600 to 1200 dpi from 300 to 400 dpi where dpi is dot number per 2.54 cm. Consequently, further precisely expression is required to the developing system.

In the case of the copying machine, the technology is also progressed to digitalization and a laser static latent image formation is mainly used. The developing system attainable the high resolution and precision of image is also required in such the method.

Responding such the situation, a toner having a small particle size is proposed in, for example, Japanese Patent Publication to Open for Public Inspection, hereinafter referred to JP O.P.I., Nos. 1-112253 and 2-284158. The size of toner particle is progressed to further smaller side.

Moreover, JP O.P.I. No. 61-279864 proposes a spherical toner having specified spherical coefficients SF-1 and SF-2. According to a study based on the example of the publication, the toner has a problem on the cleaning property thereof.

The toner image formed on the photoreceptor in the developing process is transferred onto the image receiving material in the transferring process. The toner remained on the photoreceptor after the transfer is removed in the cleaning process and stored in a discharged toner container. In the cleaning process, a cleaning means such as a blade cleaning, a far blush cleaning and roller cleaning is usually used.

Recently, a toner recycle system without formation of the discharged toner is generally utilized for the environmental preservation, in which the remained toner is reused in the developer.

When the small size toner is used in such the image forming system, the development with a sufficient stability cannot be attained for a long period because the toner is tend to be influenced by the stress in the developing apparatus such as the stress caused by the thin layer formation in the toner conveying of the non-magnetic single-component developer, the stress caused by a rubbing stress at the time of cleaning in the toner recycling system and in the toner conveying system and the contamination of the carrier in the double-component developer.

SUMMARY OF THE INVENTION

The object of the invention is to provide a toner by which images can be stably formed for a long period and an image without any image defect such as fogging and with a high resolution and precision can be obtained, and to provide an image forming method using the non-magnetic single-component developer, a toner recycling image formation method and an image forming method using the double-component developer each using the foregoing toner.

The inventors attain the invention according to the analysis of the mechanism of the deterioration of the toner.

The invention relates to a toner to be used for forming an image. The toner has shape coefficients in the specified range and the shape coefficients has a specified relation from each other and contains particles having a specified small diameter not more than a specified ratio.

(1) A toner for developing an electrostatic image comprising at least a resin and a colorant in which an arithmetic average of the shape coefficient SF-1 of the toner particles calculated by Equation 1 is from 125 to 170 and a ratio of that to an arithmetic average of the shape coefficient SF-2 of the toner particles calculated by Equation 2, SF-1/SF-2, is from 1.10 to 1.52 and the ratio of the toner particles having a circle corresponding diameter measured by a flow particle image analyzer of from not less than 0.60 to less than 1.00 μm is not more than 5.0% in number.

$$SF-1 = \frac{(\text{Maximum diameter of toner particle})^2}{(\text{Projection area of toner})} \times \frac{100\pi}{4} \quad \text{Formula (1)}$$

$$SF-2 = \frac{(\text{Circumference of toner particle})^2}{(\text{Projection area of toner})} \times \frac{100}{4\pi} \quad \text{Formula (2)}$$

(2) A production method of a toner comprising at least a step for fused resin particles in an aqueous medium in which an arithmetic average of the shape coefficient SF-1 of the toner particles calculated by Equation 1 is from 125 to 170 and a ratio of that to an arithmetic average of the shape coefficient SF-2 of the toner particles calculated by Equation 2, SF-1/SF-2, is from 1.10 to 1.52 and the ratio of the toner particles having a circle corresponding diameter measured by a flow particle image analyzer of from not less than 0.60 to less than 1.00 μm is not more than 5.0% in number.

(3) An image forming method comprising the step of developing an electrostatic latent image formed on a photoreceptor by a toner for developing a electrostatic image by the developer containing at a colored particle at least comprising a resin and a colorant and an external additive, by facing the static latent image to a layer of a developer comprising a single-component static image developing toner formed on a developer conveying member so as to touch with together, in which an arithmetic average of the shape coefficient SF-1 of the toner particles calculated by Equation 1 is from 125 to 170 and a ratio of that to an arithmetic average of the shape coefficient SF-2 of the toner particles calculated by Equation 2, SF-1/SF-2, is from 1.10 to 1.52 and the ratio of the toner particles having a circle corresponding diameter measured by a flow particle image analyzer of from not less than 0.60 to less than 1.00 μm is not more than 5.0% in number.

(4) An image forming method comprising the developing step for developing a static latent image formed on a photoreceptor by an static image developer comprising a colorant particle comprising at least a resin and a colorant and an external additive, the step for transferring the toner to an image receiving material, the step of removing the toner remained on the photoreceptor by a cleaning means and the step for recycling the toner removed from the photoreceptor to the developing step, in which an arithmetic average of the shape coefficient SF-1 of the colored particles calculated by Equation 1 is from 125 to 170 and a ratio of that to an arithmetic average of the shape coefficient SF-2 of the toner particles calculated by Equation 2, SF-1/SF-2, is from 1.10 to 1.52 and the ratio of the toner particles having a circle corresponding diameter measured by a flow particle image analyzer of from not less than 0.60 to less than 1.00 μm is not more than 5.0% in number.

(5) An image forming method comprising the step for developing an electrostatic image formed on a photoreceptor by a double-component developer comprising a carrier and a toner, in which an arithmetic average of the shape coefficient SF-1 of the colored particles calculated by Equation 1 is from 125 to 170 and a ratio of that to an arithmetic average of the shape coefficient SF-2 of the toner particles calculated by Equation 2, SF-1/SF-2, is from 1.10 to 1.52 and the ratio of the toner particles having a circle corresponding diameter measured by a flow particle image analyzer of from not less than 0.60 to less than 1.00 μm is not more than 5.0% in number.

DETAILED DESCRIPTION OF THE INVENTION

Figure 1:
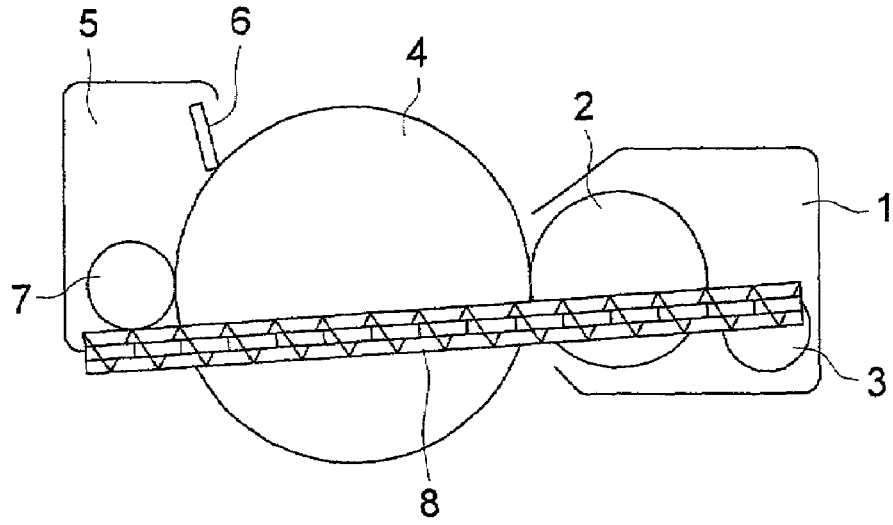
FIG. 1 shows schematic cross sectional view of an example of a toner recycle mechanism.

The fine particle contained in the toner has a large adhesion force caused by the electrostatic adhesion force and a van der Waals force and is difficultly removed when it is adhered on anything. Consequently, such the toner particle is easily melted and adhered onto the carrier and the developer conveying member when the toner containing such the fine particles is used for the image forming process accompanied with a large tress such as the toner recycling process or the non-magnetic single component process. It has been found that a problem that the charging ability of the toner is largely lowered as a result of the above-mentioned.

As a result of investigation on the particle size causing the increasing of the adhesive force, it is found that the influence is appeared when the particle having a diameter of not more than 1 μm is contained in the toner. The invention has been attained by the toner in which the content of the particles having such the diameter is reduced as small as possible, and the method for producing such the toner.

It has also been found that the adhesion force of the toner particle on the photoreceptor, developer conveying member an the carrier can be reduced and the adhesion of the fine particle composition can be inhibited by specifying the shape of the toner particle as a result of investigation on the shape of the toner particle itself. It is thought that the van der Waals force of the toner particle can be reduced by giving some degree of irregularity to the particle and the adhesion of the fine toner particle can be inhibited.

Determination of the Shape Coefficient

In the invention, the shape coefficient is determined by the following procedure:

The toner particles are photographed with a magnitude of 2,000 times by a scanning electron microscope. Then the photographic image is analyzed by Scanning Analyzer, manufactured by Nihon Denshi Co., Ltd. The shape coefficient of according to the invention is determined by the foregoing Equation with respect to 100 toner particles.

In the toner according to the invention, the arithmetic average of shape coefficient SF-1 according to the foregoing Equation 1 is within the range of from 125 to 170, the arithmetic average of SF-1 and the shape coefficient SF-2 according to the foregoing Equation 2, SF-1/SF-2, is within the range of from 1.10 to 1.52, and the content of the particles having a circle corresponding diameter measured by a flow type particle image analyzing apparatus FPIA-2000, manufactured by TOA MEDICAL ELECTRONICS CO., LTD. of not less than 0.60 and less than 1.00 μm is not more than 5.0% by number. The measuring apparatus is suitable since the shape of the particles can be monitored by real time treatment of the image while the sample liquid is passing through the apparatus.

When SF-1 is less than 125, the object of the invention is difficultly attained since the adhesion force is increased because the shape of the toner particle is made sphere and the van der Waals force of the particle is increased. When SF-1 exceeds 170, the adhesion force of the toner particle is increased since the van der Waals is reversely made strong because the irregularity of the shape is raised and the number of touching point thereof is increased. The value of SF-1 is preferably from 130 to 165, more preferably from 135 to 160.

When the ratio of SF-1 to SF-2 is less than 1.0, the object of the invention cannot be attained since the van der Waals force is increased and the adhesion force is raised. When the ratio exceeds 1.52, the adhesion force is raised because the reducing effect on the van der Waals force is reversely lowered since the irregularity of the shape of the toner particle is increased and the number of touching point is increased. It is preferable that the content of the particle having the ratio of from 1.1 to 1.52 is preferably not less than 95% in number. It is more preferable that the content of the particles having the ratio of from 1.20 to 1.35 is not less than 60% in number.

Moreover, it is necessary that the content of the particle having a circle corresponding diameter within the range of not less than 0.60 to less than 1.00 μm is not more than 5.0% in number. When the content exceeds 5.0% in number, the problems of adhesion of the fine particles to the developer conveying member, the photoreceptor and the carrier cannot be solved.

(Polymerizable Monomer)

A hydrophobic monomer is essentially used as the polymerizable monomer for producing the resin or binder used in the invention and a cross-linkable monomer is used according to necessity. As is described below, it is preferable to contain at least one kind of a monomer having an acidic polar group and a monomer having a basic polar group.

(1) Radical Polymerizable Monomer

The hydrophobic monomers can be used. One or more kinds of the monomer may be used for satisfying required properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Monomer having an Acidic Polar Group or a Basic Polar Group

As the monomer having an acidic polar group or a basic polar group, a compound containing a carboxylic acid group, a sulfonic acid group, and an amine compound such as primary amine, secondary amine, tertiary amine and quaternary amine, can be cited.

Examples of the compound containing the carboxylic acid group include acrylic acid, methacrylic acid, fumaric acid, maleic acid, itaconic acid, cinnamic acid, maleic acid monobutyl ester, maleic acid mono-octyl ester, etc.

Examples of the compound containing the sulfonic acid group include sulfonated styrene and its Na salt, allylsulfo succinic acid, allylsulfo succinic acid octyl ester and their sodium salts.

These compound includes their salt of alkali metal and alkali earth metal such as sodium, potassium or calcium.

The monomer having a basic group includes amine compounds such as dimethylaminoethylacrylate, dimethylaminoethylmethacrylate, diethylaminoethylacrylate, diethylaminoethylmethacrylate, quaternary ammonium salts of the above mentioned four compounds, 3-dimethylaminophenylacrylate and 2-hydroxy-3-methacryloxypropyl trimethylammonium salt, acrylamide, N-butylacrylamide, N,N-dibutylacrylamide, piperidylacrylamide, methacrylamide, N-butylmethacrylamide, N,N-dimethylacrylamide, N-octadecylacrylamide, vinylpyridine, vinylpyrrolidone, vinyl-N-methylpyridinium chloride, vinyl-N-ethylpyridinium chloride, N,N-di-allyl-methylammonium chloride, N,N-di-allyl-ethylammonium chloride, etc.

The radical polymerizable monomer having a basic group or an acidic group is used preferably in an amount of 0.1 to 15 weight %, and the radical crosslinking agent is preferably used in an amount of 0.1 to 10 weight % according to its characteristics with reference to monomer as a whole.

(Chain Transfer Agents)

For the purpose of regulating the molecular weight of resin particles, it is possible to employ commonly used chain transfer agents.

The chain transfer agents, for example, employed are octylmercaptan, dodecylmercaptan, tert-dodecylmercaptan, n-octyl-3-mercaptopropionate, tetrabromomethane, styrene dimer and the like.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 80° C. is employed. However, by employing a combination of polymerization initiators such as hydrogen peroxide-reducing agent (ascorbic acid and the like), which is capable of initiating the polymerization at room temperature, it is possible to carry out polymerization at least room temperature or higher.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

Further, it is possible to employ nonionic surface active agents. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

The surface active agent is employed mainly as an emulsifier, and may be used for other purpose in the other process.

Listed as colorants which constitute the toner of the present invention may be inorganic pigments, organic pigments, and dyes. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

Magnetite can be employed when the toner is used as a magnetic toner. The magnetite is used in an amount of 20 to 60% by weight in the toner in view of required magnetic characteristics.

Specific organic pigments and dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones. Further, the added amount of pigments is commonly between 2 and 20 percent by weight, and is preferably between 3 and 15 percent by weight.

Said colorants may also be employed while subjected to surface modification. As said surface modifying agents may be those conventionally known in the art, and specifically, preferably employed may be silane coupling agents, titanium coupling agents, aluminum coupling agents, and the like.

A releasing agent can be employed in the toner. Examples include a low molecular weight polyolefin wax such as polypropylene, polyethylene, paraffin wax, Fisher Tropsh wax etc. The most preferable one is an ester represented by the following formula.

$$R^1—(OCO—R^2)_n$$

In the Formula (1) n is an integer of 1 to 4, preferably 2 to 4, more preferably 3 or 4, in particular preferably 4.

$R^1$ and $R^2$ each represent a hydrocarbon group which may have a substituent. Said hydrocarbon group $R^1$ generally has from 1 to 40 carbon atoms, preferably has from 1 to 20 carbon atoms, and more preferably has from 2 to 5 carbon atoms.

Said hydrocarbon group $R^2$ generally has from 1 to 40 carbon atoms, preferably has from 16 to 30 carbon atoms, and more preferably has from 18 to 26 carbon atoms.

Listed as specific examples of specified ester compounds may be those represented by formulas 1) through 22) shown below.

1) $$CH_3—(CH_2)_{12}—COO—(CH_2)_{17}—CH_3$$

2) $$CH_3—(CH_2)_{18}—COO—(CH_2)_{17}—CH_3$$

3) $$CH_3—(CH_2)_{20}—COO—(CH_2)_{21}—CH_3$$

4) $$CH_3—(CH_2)_{14}—COO—(CH_2)_{19}—CH_3$$

5) $$CH_3—(CH_2)_{20}—COO—(CH_2)_6—O—CO—(CH_2)_{20}—CH_3$$

-continued

6)

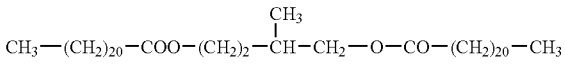

7)

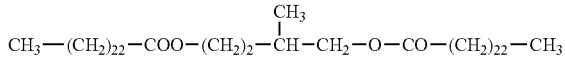

8)

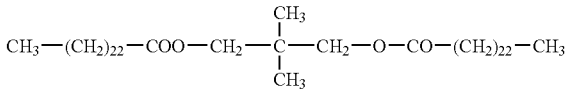

9)

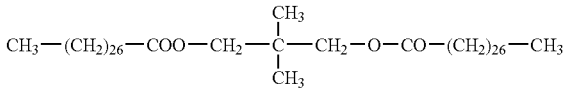

10)

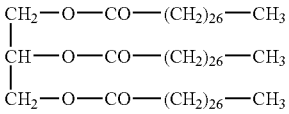

11)

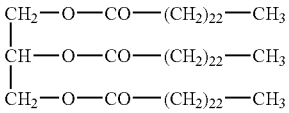

12)

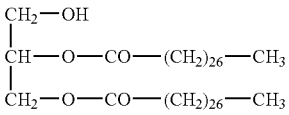

13)

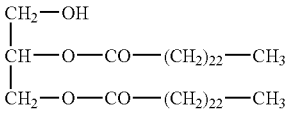

14)

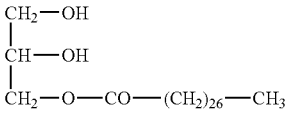

15)

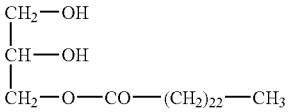

16)

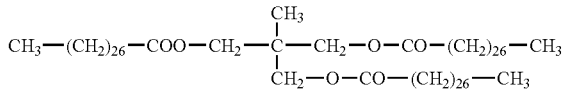

17)

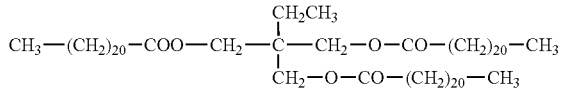

18)

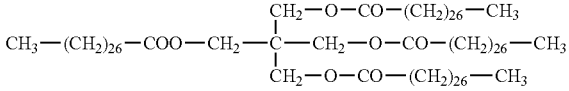

-continued

19)

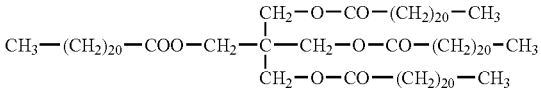

20)

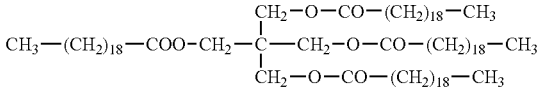

21)

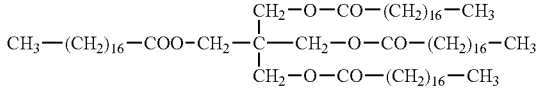

22)

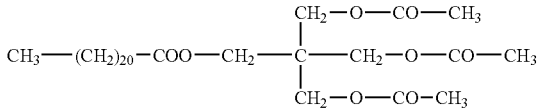

The content ratio of releasing agents in the toner is commonly 1 to 30 percent by weight, is preferably 2 to 20 percent by weight, and is more preferably 3 to 15 percent by weight.

The toner according to the invention is preferably prepared by dispersing the monomer dissolving the releasing agent in water, subjecting to polymerization to form particles containing the releasing agent inside of the particles, then salting out/fusing with colorant particles to form toner particles.

A preferable example of preparation of the polymer toner of the invention comprises steps of dispersing monomer solution dissolving a releasing agent in an aqueous medium, polymerizing the monomer to prepare resin particles containing the releasing agent within the particles, washing the obtained particles by filtration from the aqueous medium and removing a surfactant, drying the separated particles, and adding additives to the dried particles. The resin particles may be colored. Non-colored particles may also be employed, and in this instance, colored particles can be obtained by fusing resin particles in an aqueous medium after addition of colorant particles dispersion in the resin particles dispersion.

It is particularly preferable that resin particles prepared by polymerization process are subjected to salting out/fusing in the fusing process.

A charge control agent in a solid state can be added in addition to colorant or releasing agent.

The water based medium means one in which at least 50 percent, by weight of water, is incorporated.

Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

Preferable example of the polymerization method includes a radical polymerization by adding water soluble polymerization initiator in a dispersion in which monomer solution dissolving a releasing agent is dispersed as an oil droplet mechanically in an aqueous medium dissolving surfactant in concentration not less than critical micelle concentration. An oil soluble polymerization initiator may be added in the monomer in this instance.

Homogenizers employed in the dispersion of the oil droplets include, for example, "CLEARMIX", ultrasonic homogenizers, mechanical homogenizers, and Manton-Gaulin homogenizers and pressure type homogenizers such as a pressure homogenizer, medium type homogenizers such as a Getzman mill and a diamond fine mill.

Surface of the colorant particles may be modified by a surface modifier. Surface of the colorant may be modified in such way that the surface modifier is added to the dispersion of colorant, then the dispersion is heated to conduct reaction. Colorant having subjected to the surface modification is separated by filtration and dried after repeating rinsing and filtering with the same solvent.

The colorant particles are subjected to salting out/fusion process in a state that they are dispersed in water based medium. The water based medium to disperse the colorant particles includes an aqueous solution dissolving a surfactant in concentration not less than critical micelle concentration (CMC).

Examples of the surfactant include those employed in the multi-step polymerization process.

Homogenizers employed in the dispersion of the colorant particles are not particularly limited, and include, for example, "CLEARMIX", ultrasonic homogenizers, mechanical homogenizers, and Manton-Gaulin homogenizers and pressure type homogenizers such as a pressure homogenizer, medium type homogenizers such as a Getzman mill and a diamond fine mill.

Surfactant mentioned above can be used in this process.

In order to simultaneously carry out salting-out and fusion, it is required that salting agent (coagulant) is added to the dispersion of composite particles and colorant particles in an amount not less than critical micelle concentration and they are heated to a temperature of the glass transition temperature (Tg) or higher of the resin constituting composite particles.

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc. The counter ion to form the salt includes $Cl^-$, $Br^-$, $I^-$, $COO^-$, $SO_3O_4$ etc.

Time for leaving after the adding the salting agent is preferably set as short as possible when the fusion is conducted by salting out/fusing method. Though the reason therefore is not clear, however, coagulating state of the particles varies depending on the leaving time and therefore problems occurs such that the particle distribution becomes unstable or surface characteristics of the fused particles vary.

Temperature when the salting agent is added is not particularly restricted.

It is preferable that the temperature of the dispersion of the particles is raised as rapidly as possible to temperature of not less than the glass point temperature of the resin particles in the invention. Time for heating is preferably not more than 30 minutes, and more preferably 10 minutes. It is preferable to raise the temperature rapidly, for example, 1 centigrade per minutes or more rapidly, less than about 10 centigrade per minutes, so as to restrain the generation of huge particle due to the radical proceeding of salting out/fusing. In the most preferable embodiment the salting out/fusing proceeding is kept continued after the temperature reaches to glass temperature. In this instance fusion proceeds effectively at the same time of growth of the particles, and toner having improved durability can be obtained as a result.

Various material can be added to the toner to impart various characteristics to the toner other than the colorant and the releasing agent. Practically a charge control agent is mentioned. These components can be added in the various way such as adding it as well as the resin particles and colored particle at the same time, or adding it to the resin particles so as to incorporate in the toner.

With respect to said electric charge controlling agent, examples of positive electrification compounds include nigrosine dyes, naphthene acid or higher fatty acid metal salt thereof, alkoxylated amine, quaternary ammonium salts, alkylamide, azo metal complexes, metal salt of salicylic acid or metal complexes thereof.

On the other hand, for a toner prepared by a polymerization method in which resin particles are associated or fused in an aqueous medium, it is possible to optionally vary the shape distribution as well as the shape of the particles by controlling the flow of a medium and the temperature distribution in the reaction vessel during the fusing stage, and further by controlling the heating temperature, the rotational frequency while stirring, and the time during the shape controlling process, after fusing.

Namely, regarding the toner prepared by the polymerization method in which resin particles are associated or fused, it is possible to prepare a toner, having specific shape coefficient and the uniform shape distribution described in the present invention, by controlling the temperature, the rotation frequency and the time during the fusing process and shape controlling process, employing stirring blades as well as a stirring vessel which is capable of making the flow in the reaction vessel a laminar flow and the interior temperature distribution uniform. As the reason, it is assumed that when fusing is carried out in the location in which the laminar flow is generated, particles (associated or coagulated particles) while undergoing coagulation and fusing are not subjected to strong stress, and in the laminar flow in which the flow rate is accelerated, the temperature distribution in the stirring vessel is uniform, and as a result, the shape distribution of fused particles becomes uniform. Further, the fused particles are gradually varied to spherical particles by heating and stirring in the subsequent shape controlling process, and the shape of toner particles may thus be optionally controlled.

It is preferable that the salting out process and the fusing process are conducted simultaneously in order to control the shape according to the invention. Distribution of shape becomes broader and generation of fine particles is not restrained by the method of heating after formation of coagulated particles. In other words, it is assumed that coagulated particles are divided again partly and forms small particle component since the coagulated particles are heated with agitation in the water based medium.

<External Additives>

For the purpose of improving fluidity as well as chargeability, and of enhancing cleaning properties, the toner of the present invention may be employed into which so-called external additives are incorporated. Said external additives are not particularly limited, and various types of fine inorganic particles, fine organic particles, and lubricants may be employed.

Employed as fine inorganic particles may be those conventionally known in the art. Specifically, it is possible to preferably employ fine silica, titanium, and alumina particles and the like. These fine inorganic particles are preferably hydrophobic.

Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp; and the like.

Listed as fine titanium particles, for example, are commercially available T-805 and T-604, produced by Nippon Aerosil Co.; commercially available MT-100S, MT-100B, MT-500BS, MT-600, MT-600SS, and KA-1, produced by Teika Co.; commercially available TA-300SI, TA-500, TAF-130, TAF-510, and TAF-510T, produced by Fuji Titan Co.; commercially available IT-S, IT-OA, IT-OB, and IT-OC, produced by Idemitsu Kosan Co.; and the like.

Listed as fine alumina particles, for example, are commercially available RFY-C and C-604, produced by Nippon Aerosil Co., commercially available TTO-55, produced by Ishihara Sangyo Co., and the like.

Further, employed as fine organic particles are fine spherical organic particles having a number average primary particle diameter of 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably 0.1 to 5 percent by weight with respect to the toner.

Listed as members which are employed for the addition of external additives, may be various types of mixing members known in the art, such as tubular mixers, Henschel mixers, Nauter mixers, V-type mixers, and the like.

<Developers>

The toner is blended with a carrier in case that the toner is employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 μm, and is more preferably 25 to 80 μm.

The volume average particle diameter of said carrier can be generally determined employing a laser diffraction type particle diameter distribution measurement apparatus "Helos", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

Image Forming Method (Example of a Non-magnetic Single Component Toner)

Figure 2:
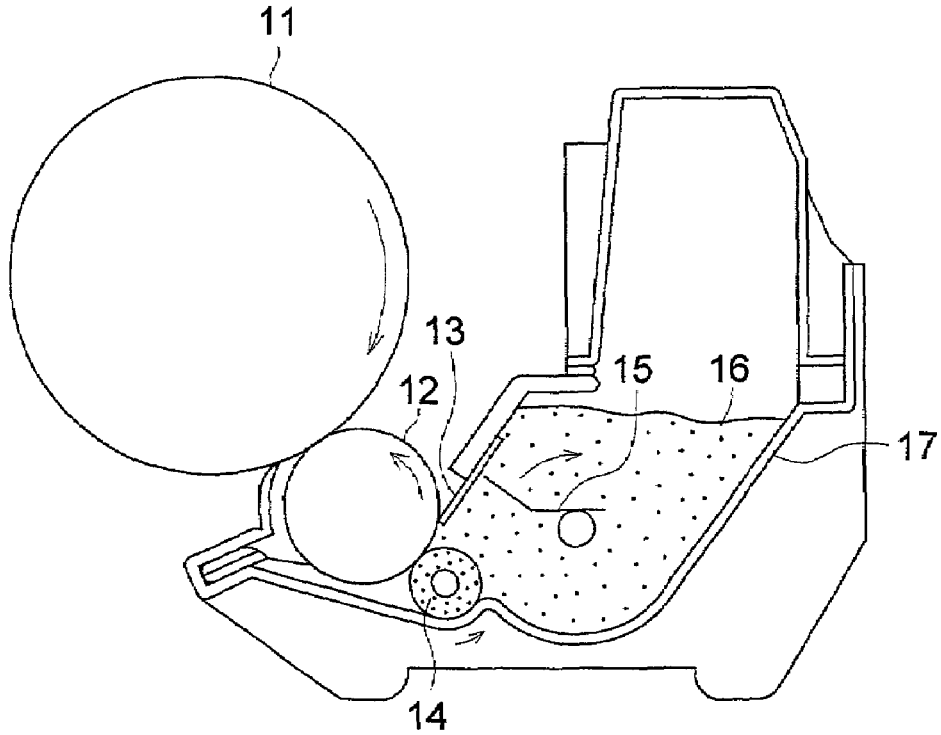
FIG. 2 shows schematic cross sectional view of a developing apparatus employed for non-magnetic single component developer.

The image forming apparatus employed in the invention includes a toner conveying member, a toner layer regulating member and a toner supplying auxiliary member, wherein each of the toner layer regulating member (13) and the toner supplying auxiliary member (14) is made contact with the toner conveying member (12) respectively, as shown in FIG. 2. The thin layered non-magnetic single component toner formed on the toner conveying member is supplied to the surface of the electrostatic latent image forming member, whereby the latent image is developed.

The toner conveying member, which supplies the non-magnetic single component toner on the electrostatic latent image forming member, is preferably comprises elastic material to obtain a sufficient area in the state that the toner conveying member is made contact with the electrostatic latent image forming member.

A roller comprising urethane rubber or silicone rubber, or an electroconductive endless belt comprising sponge roller in the inside is employed as the toner conveying member. The example of the material of the endless belt includes nickel, and PET film having electroconductive material on the surface.

The toner layer regulating member has functions of forming toner layer of uniform thickness as well as imparting triboelectric charge. The toner layer regulating member, made of an elastic body such as urethane rubber and metal plate, is brought into contact with the toner conveying member to form a toner thin layer on the toner supplying member. The toner regulating member is brought into contact with the toner conveying member with a pressure of preferably from 100 mN/cm to 5 n/cm, and more preferably from 200 mN/cm to 4 N/cm. Preferable diameter of the toner conveying member is from 10 to 50 mm.

The toner supplying auxiliary member is a unit for supplying toner to the toner supplying member stably. A roller like as a turbine having stirring blade or a sponge roller are employed for the toner supplying auxiliary member. The toner supplying auxiliary member is preferably has a diameter having 0.2 to 1.5 times of the toner supplying member.

The electrostatic latent image forming member is representatively an electro-photoreceptor. Practically it includes an inorganic photoreceptor, an amorphous silicone photoreceptor and an organic photoreceptor. The most preferable example is the organic photoreceptor, which has multi-layered structure comprising a charge generation layer and a charge transfer layer.

The toner according to the invention has specific shape, particle size and distribution thereof as mentioned above, and exchange of the toner from the toner conveying member can be improved by employing the toner.

FIG. 1 shows an example of toner recycle mechanism to which the toner of the invention is applied.

In the Figure, numeral 1 denotes a developing member, 2 is a developer conveying sleeve, 3 is a developer conveying screw, 4 is a photoreceptor, 6 is a cleaning member (blade), 7 is a recovery screw for recycle toner, and 8 is a conveying screw for recycle toner.

The remaining toner scraped by the cleaning member 6 is conveyed from cleaner part by the recovery screw for recycle toner 7, and is supplied to the developing member by the conveying screw for recycle toner 8 again.

The recycle mechanism employed in the invention is not restricted to that of FIG. 1.

The recovered toner can be sent back to the developer directly or after mixing it with a new toner in the intermediate tank preliminary.

EXAMPLE

Preparation of Latex 1

Placed into a 5,000 ml separable flask fitted with a stirring unit, a temperature sensor, a cooling pipe, and a nitrogen gas inlet was a surface active agent solution (water based medium) prepared by dissolving 7.08 g of an anionic surface active agent (sodium dodecylbenzenesulfonate: SDS) in 2,760 g of deionized water, and the interior temperature was raised to 80° C. under a nitrogen gas flow while stirring at 230 rpm.

A monomer solution was prepared in such way that 72.0 g of Exemplified Compound 19) was added to monomer mixture solution consisting of 115.1 g of styrene, 42.0 g of n-butyl acrylate, 10.9 g of methacrylic acid, and the mixture was heated to 80° C. to dissolve the monomers. The heated solution was blended and dispersed by a mechanical dispersion machine having a circulating pass, and emulsified particles having uniform particle size.

Subsequently, a solution prepared by dissolving 0.84 g of a polymerization initiator (KPS) in 200 g of deionized water was added to the surface active agent solution and it was heated and agitated at 80° C. for 3 hours, and latex particles were obtained. Subsequently a solution in which 7.73 g of a polymerization initiator (KPS) in 240 g of deionized water was added, and 15 minutes thereafter, a monomer mixture solution consisting of 383.6 g of styrene, 140.0 g of n-butyl acrylate, 36.4 g of methacrylic acid and 14.0 g of n-octyl-3-mercaptopropionic acid ester was added over 120 minutes. The agitation was kept for 60 minutes after completion of dropwise addition and it was cooled to 40° C. and latex particles were obtained.

The resulting latex was designated as Latex 1.

Example of Toner Preparation

Added to 160 ml of deionized water were 9.2 g of n-sodium dodecylsulfite to dissolve. While stirring the resulting solution, 20.0 g of carbon black, "Regal 330" (produced by Cabot Corp.), were gradually added, and subsequently dispersed employing a stirring unit, "Clearmix" (produced by M Technique Ltd.). Average weight particle diameter was 112 nm, measured by employing an electrophoresis light scattering photometer "ELS-800" (produced by Ohtsuka Denshi Co.). The resulting dispersion was designated as Colorant Dispersion 1.

Placed into a four-necked flask fitted with a temperature sensor, a cooling pipe, a nitrogen gas inlet unit, and a stirring unit having content of 5 liter were 1,250 g of Latex 1, 2,000 g of ion exchanged water, and 160 ml of Colorant Dispersion 1, and the resulting mixture was stirred. After adjusting the interior temperature to 30° C., 5M aqueous sodium hydroxide solution was added to the resulting solution, and the pH was adjusted to 10.0.

Subsequently, an aqueous solution prepared by dissolving 52.6 g of magnesium chloride tetrahydrate in 72 ml of ion exchanged water was added at 40° C. over 5 minutes. After setting the resulting mixture aside for 2 minutes, it was heated so that the temperature was raised to 90° C. within 5 minutes (at a temperature increase rate of 10° C./minute) While maintaining the resulting state, the diameter of coalesced particles was measured employing a "Coulter Counter TA-II". When the volume average particle diameter reached 6.5 μm, the growth of particles was terminated by the addition of an aqueous solution prepared by dissolving 115 g of sodium chloride in 700 ml of ion exchanged water, and further salting out/fusion was continually carried out at a liquid media temperature of 90±2° C. for 6 hours.

Thereafter, the temperature was decreased to 30° C. at a rate of 6° C./minute. Subsequently, the pH was adjusted to 2.0 by hydrochloric acid, and stirring was terminated. The resulting coalesced particles were collected through filtration, and washed with deionized water. Washed particles were then dried with air at 40° C., thus Colored Particles 1Bk was obtained.

Preparation of Yellow Colored Particles 1Y

Colored particles were obtained in the same way as Colored Particles 1Bk except that C.I. Pigment Yellow 185 was used in place of carbon black. They were designated as Yellow Colored Particles 1Y.

Preparation of Magenta Colored Particles 1M

Preparation of Cyan Colored Particles 1C

Colored particles were obtained in the same way as Colored Particles 1Bk except that C.I. Pigment Blue 15:3 was used in place of carbon black. They were designated as Cyan Colored Particles 1C.

The Colored Particles shown in the Table 1 were obtained by modifying the condition as shown in the Table. Volume average particle diameter, shape coefficient, ratio of the shape coefficient, number percent in the particle diameter range are shown in the Table 2.

TABLE 1

| | | Raising | Salting-out/Fusing | |
|---|---|---|---|---|
| Colored Particles No. | Amount of $MgCl_2$ (g) | speed of Temperature (° C./minute) | Temperature (° C.) | Maintaining time (hours) |
| 1Bk | 52.6 | 10 | 90 + 2 | 6 |
| 1Y | 52.6 | 10 | 90 + 2 | 6 |
| 1M | 52.6 | 10 | 90 + 2 | 6 |
| 1C | 52.6 | 10 | 90 + 2 | 6 |
| 2Bk | 52.6 | 20 | 90 + 2 | 6 |
| 3Bk | 52.6 | 5 | 90 + 2 | 6 |
| 4Bk | 52.6 | 10 | 80 + 2 | 6 |
| 5Bk | 52.6 | 10 | 90 + 2 | 12 |
| 6Bk | 52.6 | 10 | 90 + 2 | 9 |
| 6Y | 52.6 | 10 | 90 + 2 | 9 |
| 6M | 52.6 | 10 | 90 + 2 | 9 |
| 6C | 52.6 | 10 | 90 + 2 | 9 |
| 7Bk | 52.6 | 10 | 90 + 2 | 3 |
| 8Bk | 52.6 | 5 | 80 + 2 | 2 |
| 9Bk | 52.6 | 10 | 98 + 2 | 6 |
| 10Bk | 42.6 | 10 | 90 + 2 | 6 |
| 11Bk | 62.6 | 10 | 90 + 2 | 6 |
| 12Bk | 72.6 | 10 | 90 + 2 | 6 |

TABLE 2

| Colored Particles No. (g) | Volume average particle diameter | SF-1 | SF-1/SF-2 | Number percentage in the range of 1.10-1.52 | Number percentage in the range of 1.20-1.35 | Number percentage in the range of 0.60-1.00 |
|---|---|---|---|---|---|---|
| 1Bk | 6.5 μm | 149 | 1.35 | 98 | 68 | 1.2 |
| 1Y | 6.5 μm | 149 | 1.35 | 98 | 68 | 1.2 |
| 1M | 6.5 μm | 149 | 1.35 | 98 | 68 | 1.2 |
| 1C | 6.5 μm | 149 | 1.35 | 98 | 68 | 1.2 |
| 2Bk | 6.7 μm | 158 | 1.36 | 99 | 63 | 0.5 |
| 3Bk | 6.6 μm | 138 | 1.27 | 96 | 79 | 3.9 |
| 4Bk | 6.5 μm | 159 | 1.58 | 83 | 46 | 1.3 |
| 5Bk | 6.5 μm | 140 | 1.21 | 98 | 58 | 5.7 |
| 6Bk | 6.6 μm | 116 | 1.06 | 82 | 36 | 0.9 |
| 6Y | 6.6 μm | 116 | 1.06 | 82 | 36 | 0.9 |
| 6M | 6.6 μm | 116 | 1.06 | 82 | 36 | 0.9 |
| 6C | 6.6 μm | 116 | 1.06 | 82 | 36 | 0.9 |
| 7Bk | 6.5 μm | 146 | 1.26 | 97 | 68 | 1.0 |
| 8Bk | 6.5 μm | 163 | 1.61 | 76 | 33 | 0.8 |
| 9Bk | 6.8 μm | 119 | 1.16 | 90 | 62 | 1.5 |
| 10Bk | 6.6 μm | 151 | 1.37 | 96 | 64 | 3.2 |
| 11Bk | 6.5 μm | 148 | 1.32 | 96 | 68 | 4.2 |
| 12Bk | 6.5 μm | 147 | 1.31 | 92 | 53 | 5.2 |

Added to the colored particles were 1.0% by weight of hydrophobic silica particles (number average primary particle size of 12 nm, hydrophobicity of 68) and 0.8% by weight of hydrophobic titanium oxide particles (number average primary particle size of 20 nm, hydrophobicity of 63, and the resulting composition was stirred employing a Henschel mixer, whereby a negatively chargeable toner was obtained.

The shape and particle diameter of the colored particles do not change by the addition of the hydrophobic silica or the hydrophobic titanium oxide particles.

An image is formed by employing a developing apparatus as shown in FIG. 2, obtained by modifying digital copying machine Konica 7033.

FIG. 2 shows a schematic cross sectional view of a developing member employed in the non-magnetic single component developing method. Non-magnetic single component toner 16 contained in a toner tank 17 is stirred by stirring blade 15 and conveyed on a toner supplying auxiliary member 14 compulsory. The toner is conveyed to a toner conveying member 12 by a rotation in the arrow direction of the toner supplying auxiliary member, and is adsorbed to the surface electrostatically and physically due to friction. The toner adsorbed to the toner conveying member is made uniform thin layer and imparted triboelectricity by means of a toner layer regulating member. The thin toner layer formed on the toner conveying member develops a latent image on the photoreceptor 11 surface by contacting or approaching it.

The toner conveying member 12 was composed of silicone rubber roller having diameter of 25 mm, and the toner supplying auxiliary member 14 was composed of urethane sponge rubber in the developing apparatus. The toner layer regulating 13 member was composed of urethane rubber and the contacting stress was set as 600 mN/cm. Evaluation by actual copying was conducted by modifying so as to be copying speed of 20 sheets of A4 size paper per minutes. The multi-layered organic photoreceptor was employed. A doctor blade cleaning member was employed for cleaning remaining toner on the photoreceptor. Paper having basis weight of 55 kg was employed and image was formed in the longitudinal direction.

Accepted as a fixing member was a heat fixing member employing a pressure contact method. The constitution is described below.

The fixing member comprises an upper roller composed of a cylindrical iron tube of 30 mm diameter including a heater at the center, the surface of which is coated with a tetrafluoroethylene-perfluoroalkylvinyl ether copolymer, and a 30 mm diameter lower roller composed of silicone rubber of which surface is coated in the same manner as the upper roller with a tetrafluoroethylene-perfluoroalkylvinyl ether copolymer. The line pressure was set at 8.0 N/cm, and the nip width was set at 4.3 mm. Employing this fixing member, the printing line speed was set at 250 mm/second. The fixing temperature was controlled by regulating the surface temperature of the upper roller, the temperature of which was set at 185° C. Further, employed as the cleaning mechanism of the fixing member was a supply method employing a web method in which polydiphenylsilicone (having a viscosity of 10 Pa s at 20° C.) was impregnated.

The copying were performed continuously 50,000 sheets on an every other sheet basis under conditions of a high temperature of 30° C. and a high humid of 85% RH, employing original having line image with 5% pixel ratio. An image having solid black, half tone and solid white was copied, and the maximum density, fog density and density unevenness of thus obtained copied image were evaluated. The image density was determined by absolute reflective density measured by a densitometer RD-918 manufactured by Macbeth Co., Ltd. The fog density was measured as a relative value of density to the reflective density of paper set as 0. The unevenness of half tone image was evaluated according to the visibly with the following norms.

A: Uniform image without unevenness

B: Image having a few slight uneven lines

C: Image having several slight uneven lines

D: Image having several clear uneven lines

TABLE 3

| Example No. | Toner No. | Image density Initial | Image density After 50,000 | Fog density Initial | Fog density After 50,000 | Half tone unevenness Initial | Half tone unevenness After 50,000 |
|---|---|---|---|---|---|---|---|
| Example 1 | 1Bk | 1.40 | 1.41 | 0.001 | 0.001 | A | A |
| Example 2 | 2Bk | 1.41 | 1.40 | 0.001 | 0.001 | A | A |
| Example 3 | 3Bk | 1.40 | 1.41 | 0.001 | 0.003 | A | A |
| Example 4 | 7Bk | 1.40 | 1.41 | 0.001 | 0.002 | A | A |
| Example 5 | 10Bk | 1.40 | 1.42 | 0.001 | 0.004 | A | A |
| Example 6 | 11Bk | 1.40 | 1.42 | 0.001 | 0.004 | A | B |
| Comparative 1 | 4Bk | 1.40 | 1.36 | 0.001 | 0.005 | B | C |
| Comparative 2 | 5Bk | 1.40 | 1.42 | 0.001 | 0.012 | A | D |
| Comparative 3 | 6Bk | 1.40 | 1.41 | 0.001 | 0.011 | A | C |
| Comparative 4 | 8Bk | 1.40 | 1.43 | 0.001 | 0.010 | A | C |
| Comparative 5 | 9Bk | 1.40 | 1.41 | 0.001 | 0.011 | A | C |
| Comparative 6 | 12Bk | 1.40 | 1.44 | 0.001 | 0.015 | B | D |

TABLE 4

| Example No. | Developer No. | Image density Initial | Image density After 50,000 | Fog density Initial | Fog density After 50,000 | Half tone unevenness Initial | Half tone unevenness After 50,000 |
|---|---|---|---|---|---|---|---|
| Example 7 | 1Bk | 1.39 | 1.37 | 0.001 | 0.001 | A | A |
| Example 8 | 2Bk | 1.41 | 1.41 | 0.001 | 0.001 | A | A |
| Example 9 | 3Bk | 1.40 | 1.39 | 0.001 | 0.003 | A | A |
| Example 10 | 7Bk | 1.40 | 1.39 | 0.001 | 0.002 | A | A |
| Example 11 | 10Bk | 1.40 | 1.39 | 0.001 | 0.004 | A | A |
| Example 12 | 11Bk | 1.40 | 1.39 | 0.001 | 0.004 | A | A |
| Comparative 7 | 4Bk | 1.39 | 1.33 | 0.001 | 0.005 | B | C |
| Comparative 8 | 5Bk | 1.38 | 1.39 | 0.001 | 0.012 | A | D |
| Comparative 9 | 6Bk | 1.39 | 1.39 | 0.001 | 0.012 | A | C |
| Comparative 10 | 8Bk | 1.39 | 1.39 | 0.001 | 0.011 | A | C |
| Comparative 11 | 9Bk | 1.39 | 1.40 | 0.001 | 0.013 | A | C |
| Comparative 12 | 12Bk | 1.39 | 1.43 | 0.001 | 0.018 | B | D |

Developers having toner content of 6% were prepared by mixing silicone resin coated ferrite cores having volume average particle diameter of 60 μm to the respective toner mentioned above. These developers are denoted as Developer 1Bk through Developer 12Bk corresponding to the respective Toner 1Bk through Toner 12Bk.

Image forming test of the obtained developers was carried out employing Digital copying machine Konica 7030 which comprises toner recycle mechanism. Remaining toner after transfer process was removed by blade type cleaning member, and the collected toner was carried back to the developer by means of recycle toner conveying member.

A heat fixing member employing a pressure contact method was used, which is detailed below.

The fixing member comprises an upper roller composed of a cylindrical aluminum alloy tube of 30 mm inner diameter and 310 mm width having a thickness of 0.8 mm and including a heater at the center, the surface of which is covered with a tetrafluoroethylene-perfluoroalkylvinyl ether copolymer in 120 μm thickness, and a lower roller composed of a cylindrical iron tube of 30 mm inner diameter having a thickness of 1.0 mm covered with silicone rubber sponge having Ascar C hardness of 48 and thickness of 2 mm. The nip width was set at 3.8 mm. Employing this fixing member, the printing line speed was set at 180 mm/second.

The fixing temperature was controlled by regulating the surface temperature of the upper roller, the temperature of which was set at 180° C.

The copying were carried out continuously 10,000 sheets under conditions of a high temperature of 30° C. and a high humid of 80% RH, employing original having line image with 5% pixel ratio, then the machine including developer was left for four days in the same condition, and then an image having solid black, half tone and solid white was copied. The maximum density, fog density and density unevenness of thus obtained copied image were evaluated before and after four days leaving. The image density was determined by absolute reflective density measured by a densitometer RD-918 manufactured by Macbeth Co., Ltd. The fog density was measured as a relative value of density to the reflective density of paper set as 0.

Developer group of yellow, magenta and cyan were prepared in the same way as the black developer, and they were subjected to test by employing color copying machine having intermediate transfer mechanism. Developing member including yellow, magenta, cyan and black developers were set around the multi-layered photoreceptor. Each color image developed on the photoreceptor was transferred to the intermediate transfer material respectively to form a full color image on the intermediate transfer material, and then the image was transferred to paper (an image forming support). The photoreceptor was cleaned by blade type cleaner.

A pressure-contact type heat fixing member was employed.

The copying were carried out continuously 10,000 sheets under conditions of a high temperature of 30° C. and a high humid of 80% RH, employing original having full color image with 25% pixel ratio, then the machine including developer was left for four days in the same condition, and then the image was copied. Color difference before and after the four days was evaluated as chroma difference. The test method is mentioned below.

The secondary colors (red, blue, and green) of the solid image portion in each of images formed on the first sheet and 20,000th sheet were measured by a Macbeth Color-Eye 7000• and the color difference was calculated employing a CMC (2:1) color difference formula.

When the color difference obtained by the CMC (2:1) color difference formula was not more than 5, the variation of hue of the formed images was judged to be within the tolerance range.

TABLE 5

| Example No. | Developer combination | Color difference |
|---|---|---|
| Example 13 | Developers 1Bk, 1Y, 1M and 1C | 2 |
| Comparative 13 | Developers 6Bk, 6Y, 6M and 6C | 8 |

Images can be stably formed for a long period and an image without any image defect such as fogging and with a high resolution and precision can be obtained, and to provide an image forming method using the non-magnetic single-component developer, a toner recycling image formation method and an image forming method using the double-component developer each using the foregoing toner by employing a toner for developing an electrostatic image comprising at least a resin and a colorant in which an arithmetic average of the shape coefficient SF-1 of the toner particles calculated by Equation 1 is from 125 to 170 and a ratio of that to an arithmetic average of the shape coefficient SF-2 of the toner particles calculated by Equation 2, SF-1/SF-2, is from 1.10 to 1.52 and the ratio of the toner particles having a circle corresponding diameter measured by a flow particle image analyzer of from not less than 60 to less than 1.00 μm is not more than 5.0% in number.

The invention claimed is:

1. A toner for developing an electrostatic image comprising a resin and a colorant in which an arithmetic average of shape coefficient SF-1 of the toner particles calculated by Equation 1 is from 125 to 170 and a ratio of that to an arithmetic average of the shape coefficient SF-2 of the toner particles calculated by Equation 2, SF-1/SF-2, is from 1.10 to 1.52 and the ratio of the toner particles having a circle corresponding diameter measured by a flow particle image analyzer of from not less than 0.60 to less than 1.00 μm is not more than 5.0% in number, and the resin is a polymer comprising radical polymerized monomers and 0.1 to 15 weight % of the monomers based on the total weight of monomers, have a basic group or an acidic group, $$SF-1=\frac{(\text{Maximum diameter of toner particle})^2}{(\text{Projection area of toner})}\times\frac{100\pi}{4} \quad \text{Formula (1)}$$

$$SF-2=\frac{(\text{Circumference of toner particle})^2}{(\text{Projection area of toner})}\times\frac{100}{4\pi}. \quad \text{Formula (2)}$$

2. The toner of claim 1 wherein the content of the particles having the ratio SF1/SF-2 of from 1.20 to 1.35, is not less than 60% in number.

3. The toner of claim 1 wherein the value of SF-1 is from 130 to 165.

4. The toner of claim 3 wherein the value of SF-1 is from 135 to 160.

5. The toner of claim 3, comprising a compound represented by following formula:

$R_1(OCOR_2)n$ wherein n is an integer of 1 to 4; $R_1$ and $R_2$ each represent a hydrocarbon group which may have a substituent.

6. The toner of claim 1, wherein ratio of toner particles having the ratio SF1/SF2 of from 1.1 to 1.52 is not less than 95% in number.

7. The toner of claim 1, wherein ratio of toner particles having the ratio SF1/SF-2 of from 1.20 to 1.35 is not less than 60% in number.

8. The toner of claim 1, wherein the radical polymerizable monomers include monomers selected from the group consisting of aromatic vinyl monomers, acrylic acid ester based monomers, methacrylic acid ester based monomers, vinyl ester based monomers, vinyl ether based monomers, monoolefin based monomers, diolefin based monomers, and halogenated olefin monomers.

9. The toner of claim 1, wherein the radical polymerizable monomer having a basic group or an acidic group is a compound containing a carboxylic acid or sulfonic acid group, or an amine compound.

10. The toner of claim 1, wherein the monomers comprise a cross-linking agent.

11. A production method of a toner comprising a resin and a colorant wherein the method comprises a step of fusing resin particles in an aqueous medium, in which an arithmetic average of the shape coefficient SF-1 of the toner particles calculated by Equation 1 is from 125 to 170 and a ratio of that to an arithmetic average of the shape coefficient SF-2 of the toner particles calculated by Equation 2, SF-1/SF2, is from 1.10 to 1.52 and the ratio of the toner particles having a circle corresponding diameter measured by a flow particle image analyzer of from not less than 0.60 to less than 1.00 μm is not more than 5.0% in number and the resin is a polymer comprising radical polymerized monomers and 0.1 to 15 weight % of the monomers based on the total weight of monomers, have a basic group or an acidic group $$SF-1=\frac{(\text{Maximum diameter of toner particle})^2}{(\text{Projection area of toner})}\times\frac{100\pi}{4} \quad \text{Formula (1)}$$

$$SF-2=\frac{(\text{Circumference of toner particle})^2}{(\text{Projection area of toner})}\times\frac{100}{4\pi}. \quad \text{Formula (2)}$$

12. An image forming method comprising developing an electrostatic latent image formed on a photoreceptor by touching the static latent image to a layer of a single-component developer formed on a developer conveying member in which the single-component developer comprises a toner comprising a resin and a colorant and an external additive, an arithmetic average of the shape coefficient SF-1 of the toner particles calculated by Equation 1 is from 125 to 170 and a ratio of that to an arithmetic average of the shape coefficient SF-2 of the toner particles calculated by Equation 2, SF-1/SF-2, is from 1.10 to 1.52 and the ratio of the toner particles having a circle corresponding diameter measured by a flow particle image analyzer of from not less than 0.60 to less than 1.00 μm is not more than 5.0% in number and the resin is a polymer comprising radical polymerized monomers and 0.1 to 15 weight % of the monomers based on the total weight of monomers, have a basic group or an acidic group $$SF-1=\frac{(\text{Maximum diameter of toner particle})^2}{(\text{Projection area of toner})}\times\frac{100\pi}{4} \quad \text{Formula (1)}$$

$$SF-2=\frac{(\text{Circumference of toner particle})^2}{(\text{Projection area of toner})}\times\frac{100}{4\pi}. \quad \text{Formula (2)}$$

13. An image forming method comprising a developing step of developing a static latent image formed on a photoreceptor by an static image developer comprising a toner comprising a resin and a colorant and an external additive, a step of transferring the toner to an image receiving material, a step of removing the toner remaining on the photoreceptor by a cleaning member and a step of recycling the toner removed from the photoreceptor to the developing step, in which an arithmetic average of the shape coefficient SF-1 of the toner particles calculated by Equation 1 is from 125 to 170 and a ratio of that to an arithmetic average of the shape coefficient SF-2 of the toner particles calculated by Equation 2, SF1/SF-2, is from 1.10 to 1.52 and the ratio of the toner particles having a circle corresponding diameter measured by a flow particle image analyzer of from not less than 0.60 to less than 1.00 μm is not more than 5.0% in number and the resin is a polymer comprising radical polymerized monomers and 0.1 to 15 weight % of the monomers based on the total weight of monomers, have a basic group or an acidic group $$SF-1=\frac{(\text{Maximum diameter of toner particle})^2}{(\text{Projection area of toner})}\times\frac{100\pi}{4} \quad \text{Formula (1)}$$

$$SF-2=\frac{(\text{Circumference of toner particle})^2}{(\text{Projection area of toner})}\times\frac{100}{4\pi}. \quad \text{Formula (2)}$$

14. An image forming method comprising a step of developing an electrostatic image formed on a photoreceptor by double-component developer comprising a carrier and a toner comprising a resin and a colorant, in which an arithmetic average of the shape coefficient SF-1 of the toner particles calculated by Equation 1 is from 125 to 170 and a ratio of that to an arithmetic average of the shape coefficient SF-2 of the toner particles calculated by Equation 2, SF1/SF-2, is from 1.10 to 1.52 and the ratio of the toner particles having a circle corresponding diameter measured by a flow particle image analyzer of from not less than 0.60 to less than 1.00 μm is not more than 5.0% in number and the resin is a polymer comprising radical polymerized monomers and 0.1 to 15 weight % of the monomers based on the total weight of monomers, have a basic group or an acidic group $$SF-1=\frac{(\text{Maximum diameter of toner particle})^2}{(\text{Projection area of toner})}\times\frac{100\pi}{4} \quad \text{Formula (1)}$$

$$SF-2=\frac{(\text{Circumference of toner particle})^2}{(\text{Projection area of toner})}\times\frac{100}{4\pi}. \quad \text{Formula (2)}$$

* * * * *